US009790604B2

(12) United States Patent
Steyer

(10) Patent No.: US 9,790,604 B2
(45) Date of Patent: Oct. 17, 2017

(54) REPLACEMENT COMPONENT FOR ELECTROLYSER FLANGES

(75) Inventor: Timo Steyer, Linsengericht Altenhasslau (DE)

(73) Assignee: UHDENORA S.P.A., Milan (IT)

( * ) Notice: Subject to any disclaimer, the term of this patent is extended or adjusted under 35 U.S.C. 154(b) by 0 days.

(21) Appl. No.: 14/113,272

(22) PCT Filed: Jun. 14, 2012

(86) PCT No.: PCT/EP2012/061360

§ 371 (c)(1),
(2), (4) Date: Dec. 6, 2013

(87) PCT Pub. No.: WO2012/172021

PCT Pub. Date: Dec. 20, 2012

(65) Prior Publication Data

US 2014/0110250 A1 Apr. 24, 2014

(30) Foreign Application Priority Data

Jun. 14, 2011 (IT) ..... MI2011A1070

(51) Int. Cl.
*C25B 9/00* (2006.01)
*C25B 9/18* (2006.01)
*C25B 15/00* (2006.01)

(52) U.S. Cl.
CPC ..... *C25B 9/00* (2013.01); *C25B 9/18* (2013.01); *C25B 15/00* (2013.01); *Y10T 29/49718* (2015.01)

(58) Field of Classification Search
CPC .. C25B 9/00; C25B 9/18; C25B 15/00; Y10T 29/49718
See application file for complete search history.

(56) References Cited

U.S. PATENT DOCUMENTS

| | | | | |
|---|---|---|---|---|
| 3,877,730 | A | 4/1975 | Frantz | |
| 4,108,752 | A * | 8/1978 | Pohto et al. | 204/256 |
| 4,654,136 | A * | 3/1987 | Dang et al. | 204/283 |
| 5,454,925 | A * | 10/1995 | Garland et al. | 204/280 |
| 2008/0219902 | A1 * | 9/2008 | Sakai et al. | 422/200 |

FOREIGN PATENT DOCUMENTS

| | | |
|---|---|---|
| EP | 0187273 | 7/1986 |

OTHER PUBLICATIONS

International Search Report issued in PCT Application No. PCT/EP2012/061360.
Written Opinion of International Searching Authority issued in PCT Application No. PCT/EP2012/061360.

* cited by examiner

*Primary Examiner* — Ciel Thomas
(74) *Attorney, Agent, or Firm* — Lucas & Mercanti, LLP

(57) ABSTRACT

The invention relates to a cell of a modular electrolyzer having a frame-shaped flange formed by two superposed elements, welded along the internal periphery in order to increase the local flange thickness in a portion of higher exposure to corrosion, for the sake of improving its resistance. A method of repairing electrolysis cells having a frame-shaped flange formed by two superposed elements by removing and replacing only the outermost frame, more subject to corrosion, is also described.

6 Claims, 1 Drawing Sheet

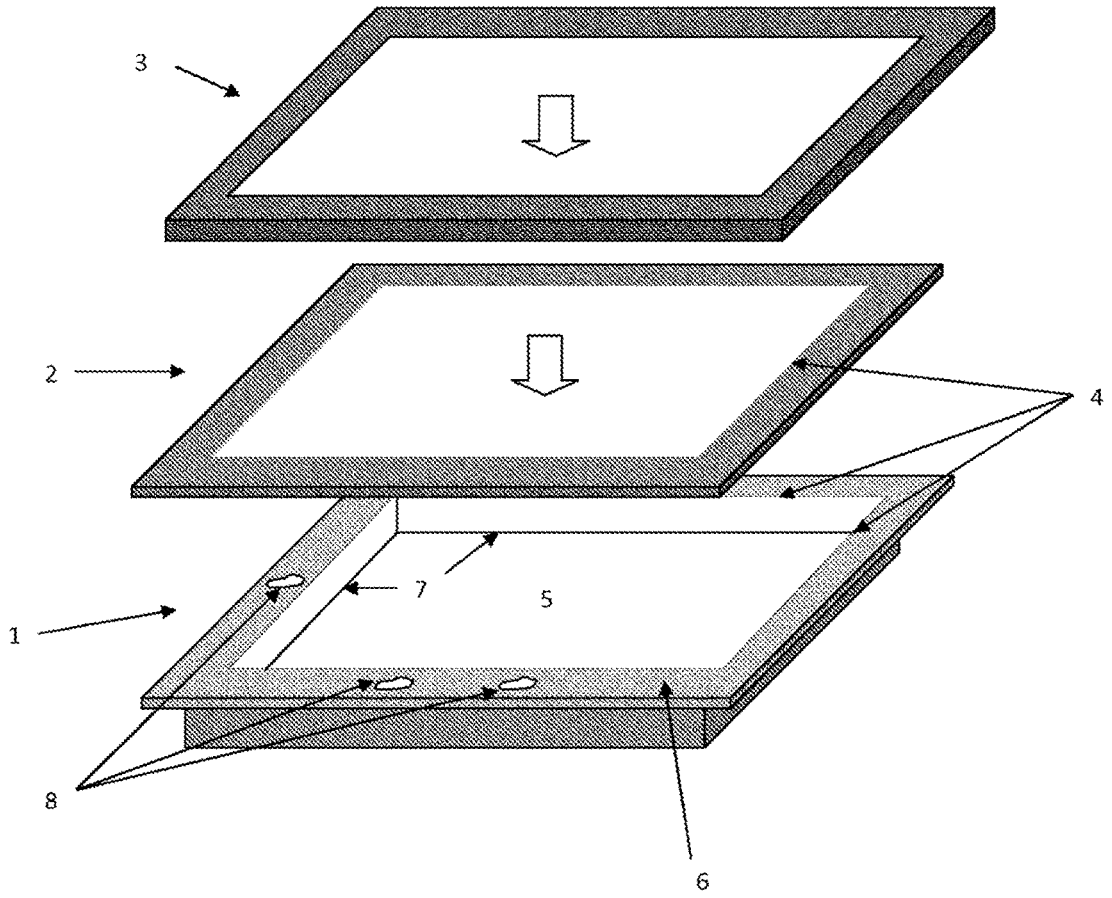
3
2
4
7
5
1
8
6

REPLACEMENT COMPONENT FOR ELECTROLYSER FLANGES

This application is a U.S. national stage of PCT/EP2012/061360 filed on Jun. 14, 2012 which claims the benefit of priority from Italian Patent Application No. MI2011A001070 filed Jun. 14, 2011, the contents of each of which are incorporated herein by reference.

FIELD OF THE INVENTION

The invention relates to a cell element, of an electrolyser comprised of a modular arrangement of electrochemical cells, each cell including at least one pan-shaped shell comprising two flange elements in form of frames mutually welded along their internal periphery. The addition of a second flange element allows increasing the overall flange thickness in a zone of higher exposure to corrosion thereby improving the corrosion resistance thereof. The invention also provides a quick, cheap and effective method of repairing a flange damaged by corrosion.

BACKGROUND OF THE INVENTION

Flange corrosion phenomena affecting electrolysers are known to those skilled in the art. These phenomena take place especially in outer flange zones, in correspondence of gaskets. In such zones in fact, the stagnation of corrosive substances and the lack of oxygen needed for supporting passivation and hence for ensuring protection of the metallic material favour the onset of corrosion. To prevent these phenomena it is possible to rely on the activation of the flange by coating the same with a catalytic layer, for instance made of platinum or ruthenium oxide. This procedure is nevertheless complicated since coating with a catalyst requires high temperature treatments which may bring about a deformation of the flange.

On the other hand, if the flange has already been attacked by corrosion, an intervention is required to prevent its punching and the consequent leakage of matter from the electrolyser.

The methods known in the art provide in this case the removal of the damaged part, which requires cleaning the zone affected by corrosion and subsequently welding new material in correspondence therewith. This procedure however presents serious limitations since the stagnation of corrosive substances and corrosion by-products —such as TiH— in the corrosion zone hampers the effectiveness of the subsequent weld. These substances must therefore be removed very carefully in order to obtain a locally effective weld, which entails lengthy operations often leading to non optimal results.

It has thus been evidenced the need of providing a new method of corrosion prevention and new repairing techniques of corroded parts characterised by being quick, cheap and straightforward.

DESCRIPTION OF THE INVENTION

Various aspects of the invention are set out in the accompanying claims.

Under one aspect, the invention relates to a cell of an electrolyser consisting of a modular arrangement of electrochemical cells, each cell comprising at least one pan consisting of a back-wall and a first flange element in form of frame made of a first metallic material, said first flange element integral with said back-wall or alternatively secured thereto along the periphery, a second flange element in form of planar frame made of a second metallic material fixed to said first flange element, said fixing being a weld localised along the internal edges of said first flange element and said second flange element. This type of solution allows protracting the lifetime of the flange against corrosion phenomena upon increasing the flange thickness. On the other hand, the application of the planar frame only in correspondence of the flange portion more sensitive to corrosion rather than on the entire back-wall allows a remarkable material savings.

Under another aspect, the invention relates to a method of repairing a cell of an electrolyser consisting of a modular arrangement of electrochemical cells, each comprising a pan consisting of a back-wall and a first flange element in form of frame made of a first metallic material, said first flange element integral with said back-wall or alternatively secured thereto along the periphery, said first flange element being damaged by corrosion, comprising fixing a second flange element in form of planar frame of a second metallic material to said first flange element, wherein said fixing is a weld localised along the internal edges of said first flange element and said second flange element. Being the welding of this second flange element carried out along the internal perimeter of the two frames, the operation results much easier and more advantageous than those of the prior art involving a clean zone without directly concerning the corrosion zone.

In one embodiment, said first metallic material of said first flange element and said second metallic material of said second flange element are the same material.

In another embodiment, said first metallic material of said first flange element is titanium and said second metallic material of said second flange element is an alloy of titanium and palladium.

Under another aspect, the invention relates to a method of repairing a cell of an electrolyser consisting of a modular arrangement of electrochemical cells, said cell comprising a pan consisting of a back-wall and a first flange element in form of frame made of a first metallic material, a second flange element in form of planar frame of a second metallic material secured to said first flange element, wherein said fixing is a weld localised along the internal edges of said first flange element and said second flange element, comprising the removal of said second flange element in form of planar frame, if damaged by corrosion, from said first flange element, the subsequent fixing of a new flange element in form of planar frame, wherein said fixing is a weld localised along the internal edges of said first flange element and said new flange element.

A few embodiments exemplifying the invention are described hereunder making reference to the attached drawing, which has the sole purpose of illustrating the reciprocal arrangement of the different elements in particular embodiments of the invention; in particular, the drawing shall not be intended as a scale reproduction.

BRIEF DESCRIPTION OF THE DRAWING

The drawing shows a three-dimensional schematic exploded view of a possible embodiment of the invention comprising a pan, a frame and a gasket.

DETAILED DESCRIPTION OF THE DRAWING

An embodiment of the invention is shown in the FIGURE, comprising a pan 1 consisting of a back-wall 5 and a first frame-shaped flange element 6. When not integral with the back-wall 5, said first flange element 6 is welded thereto along the periphery 7. A second flange element in form of planar frame 2 is secured by welding along the internal perimeter of the two frames 4 covering the zones affected by corrosion 8. A gasket 3 is then arranged above the second flange element 2.

EXAMPLE

Two TiPd stripes of 1.0 mm×27.0 mm×2129 mm size and two TiPd stripes of 1.0 mm×25.0 mm×1214 mm size were machine-drawn. The four stripes were then welded in order to form a 1.0 mm-thick rectangular shaped frame (see drawing). The frame was then leaned above the equally-shaped flange and aligned therewith. The flange and frame were first secured by tightening devices then fixed by spot-welding every 100 mm on the external perimeter and every 30 mm on the internal perimeter. The flange and frame were then TIG-welded along the whole internal perimeter.

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements, components or additional process steps.

The invention claimed is:

1. A cell of an electrolyzer consisting of a modular arrangement of electrochemical cells, said cell comprising:

at least one pan-shaped shell having an internal cavity and a peripheral surface;

a first frame-shaped flange element, being integral with said pan-shaped shell or alternatively secured thereto, having a first internal periphery facing the internal cavity of the pan-shaped shell and a peripheral flange projecting from the peripheral surface of the pan-shaped shell, said first frame-shaped flange element made of a first metallic material, and a second frame-shaped flange element being a corresponding mirror image to said first frame-shaped flange element, made of a second metallic material and having a second internal periphery facing the internal cavity of the pan-shaped shell, wherein said first frame-shaped flange element and said second frame-shaped flange element are welded throughout the first internal periphery and the second internal periphery, and wherein the welding throughout the first and second internal peripheries improves corrosion resistance and increases the thickness of the frame-shaped flange elements.

2. The cell according to claim 1, wherein said first metallic material of said first frame-shaped flange element and said second metallic material of said second frame-shaped flange element are the same material.

3. The cell according to claim 1, wherein said first metallic material of said first frame-shaped flange element is titanium and said second metallic material of said second frame-shaped flange element is an alloy of titanium and palladium.

4. A method of repairing a cell of an electrolyzer consisting of a modular arrangement of electrochemical cells according to claim 1, comprising:

obtaining the electrochemical cell of claim 1, wherein said first frame-shaped flange element is damaged by corrosion, affixing said second frame-shaped flange element of the second metallic material to said first frame-shaped flange element by welding along the internal periphery between said first frame-shaped flange element and said frame-shaped second flange element.

5. The method of repairing a cell according to claim 4, wherein said first metallic material of said first flange element is titanium and said second metallic material of said second flange element is an alloy of titanium and palladium.

6. A method of repairing a cell of an electrolyzer consisting of a modular arrangement of electrochemical cells according to claim 1 comprising:

removing said second frame-shaped flange element from said first frame-shaped flange element, and subsequently fixing a new frame-shaped flange element by welding along the internal periphery between said first frame-shaped flange element and said new frame-shaped flange element.

* * * * *